US006100225A

United States Patent [19]

Kalhan et al.

[11] Patent Number: 6,100,225

[45] Date of Patent: Aug. 8, 2000

[54] SULFONATE CONTAINING COPOLYMERS AS MIST SUPPRESSANTS INSOLUBLE OIL (WATER-BASED) METAL WORKING FLUIDS

[75] Inventors: Sanjay Kalhan, Willoughby Hills; James T. Mann, Hudson; Richard A. Denis, Auburn Township, all of Ohio

[73] Assignee: The Lubrizol Corporation, Wickliffe, Ohio

[21] Appl. No.: 08/897,938

[22] Filed: Jul. 21, 1997

Related U.S. Application Data

[63] Continuation-in-part of application No. 08/644,600, May 13, 1996, abandoned.

[51] Int. Cl.[7] ..... C10M 149/06

[52] U.S. Cl. ..... 508/404; 508/470; 508/471; 516/114

[58] Field of Search ..... 516/114; 508/404, 508/470, 471

[56] References Cited

U.S. PATENT DOCUMENTS

| | | | |
|---|---|---|---|
| 3,833,502 | 9/1974 | Leary et al. | 252/49.5 |
| 4,293,427 | 10/1981 | Lucas et al. | 507/121 |
| 4,404,111 | 9/1983 | Bi et al. | 507/121 |
| 4,432,881 | 2/1984 | Evani | 252/8.5 A |
| 4,493,777 | 1/1985 | Snyder et al. | 508/507 |
| 4,520,182 | 5/1985 | Turner et al. | 526/307.2 |
| 4,536,539 | 8/1985 | Lundberg et al. | 524/521 |
| 4,563,294 | 1/1986 | Geymayer et al. | 508/404 |
| 4,770,814 | 9/1988 | Rose et al. | 252/315.4 |
| 4,812,544 | 3/1989 | Sopko et al. | 526/73 |
| 4,880,565 | 11/1989 | Rose et al. | 252/355 |
| 5,021,526 | 6/1991 | Ball | 526/240 |
| 5,039,433 | 8/1991 | Sopko et al. | 507/121 |
| 5,089,578 | 2/1992 | Valint et al. | 526/240 |
| 5,134,118 | 7/1992 | Patel et al. | 507/121 |
| 5,294,651 | 3/1994 | Stephens | 524/3 |
| 5,302,192 | 4/1994 | McLearie et al. | 106/18.33 |

FOREIGN PATENT DOCUMENTS

WO93/24601 12/1993 WIPO .

*Primary Examiner*—Margaret Medley
*Assistant Examiner*—Cephia D. Toomer
*Attorney, Agent, or Firm*—David M. Shold

[57] ABSTRACT

Aqueous metal working fluids containing a mist suppressing copolymer are disclosed. The copolymer includes hydrophobic and hydrophilic monomers. Optionally, the metal working fluid may be an oil-in-water emulsion.

29 Claims, No Drawings

SULFONATE CONTAINING COPOLYMERS AS MIST SUPPRESSANTS INSOLUBLE OIL (WATER-BASED) METAL WORKING FLUIDS

RELATED U.S. APPLICATION DATA

This is a continuation-in-part of copending application Ser. No. 08/644,600, filed May 13 ,1996, now abandond.

BACKGROUND OF THE INVENTION

This invention relates to aqueous metal working fluids comprising of water and a mist suppressing copolymer. Optionally, the fluid may be an oil-in-water emulsion. Such emulsions include oil and an emulsifier. In addition to the mist suppressing copolymer, metal cutting operations often involve a work piece which rotates at relatively high speed, and a cutting tool both of which are lubricated by a metal working fluid. Under these conditions, the metal working fluid is frequently thrown from the surface of the metal in the form of droplets. Often the droplets are small enough to be classified as a mist. Misting, or the formation of a mist is considered undesirable, because it represents a loss of the cutting fluid, and the cutting fluid mist is considered a contaminant in the air around the cutting machine.

Polymers containing acrylamides are known to thicken aqueous materials.

U.S. Pat. No. 4,432,881 discloses an aqueous composition containing a water soluble polymer having pendant hydrophobic groups, e.g., an acrylamide/dodecyl acrylate copolymer, and a water dispersible surfactant, e.g., sodium oleate or dodecyl polyethyleneoxyglycol mono ether. Exemplary, water soluble monomers include ethylenically unsaturated amides such as acrylamide and 2-acrylamido-2 methylpropane sulfonic acid. The molar ratio of the water soluble monomer to the hydrophobic monomer is in the range from 98:2 to about 99.995:0.005. The uses disclosed for the composition, include enhanced oil recovery processes, as fluid mobility control agents, fracturing fluids and drilling muds as well as hydraulic fluids and lubricants. The use of the composition in metal working fluids is not a disclosed application.

U.S. Pat. No. 4,520,182 discloses water soluble acrylamide/alkyl acrylamide copolymers which are efficient viscosifiers of water or brine. It also discloses a process for the copolymerization of water insoluble acrylamides with water soluble acrylamide. The mole percentage of the water soluble acrylamide in the composition ranges from about 90.1 to about 99.9 mole percent.

U.S. Pat. No. 5,089,578 discloses novel hydrophobically associated terpolymers containing sulfonate functionality which are useful as aqueous fluid rheology or flow control modifiers. The water soluble monomers are acrylamide and a salt of an ethylenically unsaturated sulfonic acid and the water insoluble monomer is a higher alkyl acrylamide. The ethylenically unsaturated sulfonic acids include materials such as sodium 2-acrylamido-2 methylpropane sulfonate. The mole percentage of acrylamide is preferably about 5 to about 98, more preferably 10 to 90 mole percent, the mole percentage of the salt of the sulfonate containing monomer is preferably from about 2 to about 95, and the mole percentage of the hydrophobic monomer is preferably from about 0.1 to about 10.0, more preferably 0.2 to 5 mole percent. Metal working applications are not disclosed.

Acrylic polymers are used to control misting in metal working applications. U.S. Pat. No. 3,833,502 discloses water based metal working fluids which incorporate small amounts of water-soluble polymers. The polymers disclosed fall into three (3) classes. Anionic polymers, cationic polymers, and nonionic polymers which contain a sufficient number of hydrophilic groups to be water-dispersible.

U.S. Pat. No. 4,493,777 discloses substantially oil free aqueous industrial fluids possessing superior lubricating and wear preventing characteristics which are useful as hydraulic fluids and metal working compositions. The fluids of the invention comprised one (1) an aqueous liquid and (2) a water soluble synthetic addition copolymer of (a) an ethylenically unsaturated cross-linking monomer, (b) an ethylenically unsaturated water soluble monomer and (c) an ethylenically unsaturated water insoluble monomer. The water soluble monomers include acrylamido-2-methylpropane sulfonic acid. Water insoluble monomers include styrene compounds, vinyl esters and acrylate esters. The cross-linking monomers are polyvinyl compounds which are present in amounts sufficient to control the degree of swellability of said copolymerization product, while imparting mechanical reinforcement to said copolymerization product.

U.S. Pat. No. 4,770,814, and its Divisional patent Ser. No. 4,880,565 disclose shear stable aqueous anti-misting compositions suitable for metal working. The compositions contain a viscoelastic surfactant, that is, a surfactant compound having a hydrophobic moiety chemically bonded to an ionic hydrophilic moiety and an electrolyte having a moiety that is capable of associating with the surfactant ion. The viscoelastic surfactant can also be a non-ionic surfactant. The disclosed surfactants are monomeric.

International patent WO93/24601 discloses clear water-soluble polymer compounds having mean molecular weight higher than 1 million and selected among the polyalkylene oxides, polyacrylamides, polymethacrylarnides, and the copolymers of an acrylamide and/or methyl acrylamide with unsaturated organic carboxylic acids having three (3) to five (5) carbon atoms. which are used in water-miscible and water mixed cooling lubricants, to reduce mist formation.

Polymeric anti-misting additives reduce the misting of machine fluids at the source by stabilizing them against break-up during the extreme shear conditions which occur during metal working operations. High molecular weight poly(ethylene oxide) is commonly used in this application. A typical polymer is POLYOX® available from Union Carbide. Typically, these polymers have a molecular weight from 1 to 2 million. However, these polymers are susceptible to shear. Metal working application often involve high shear, and as a result, metal working fluids containing high molecular weight poly(ethylene oxide) often suffer in performance when subjected to shear. Such degradation results when high shear conditions cause high molecular weight poly(ethylene oxide) to break down and lose its ability to suppress mist formation. In such high shear applications, the polymer must be replenished frequently.

SUMMARY OF INVENTION

An aqueous metal working fluid comprising water, and a mist suppressing copolymer formed by copolymerizing (A) a hydrophobic monomer selected from the group consisting of A(I) an alkyl substituted acrylamide compound having the formula:

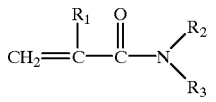

wherein $R_1$ is a hydrogen or a methyl group and $R_2$ and $R_3$ are independently hydrogen or hydrocarbyl groups, provided that the total number of carbon atoms in $R_2$ and $R_3$ combined is between 2 and 36, and A(II) an acrylate ester of the following formula:

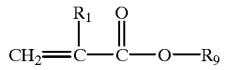

where $R_1$ is a hydrogen or a methyl group and $R_9$ is a hydrocarbyl group containing between 1 and 20 carbon atoms; and (B) a hydrophilic monomer compound selected from the group consisting of B(I) acrylamido sulfonic acids having the formula:

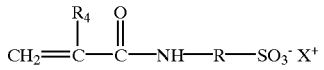

wherein $R_4$ is a hydrogen or a methyl group and R is an aliphatic or aromatic hydrocarbon group containing from 2 to 8 carbon atoms; B(II) acrylamido disulfonic acids having the formula:

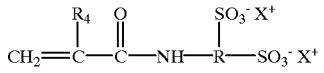

wherein $R_4$ is a hydrogen or a methyl group and R is an aliphatic or aromatic hydrocarbon group containing from 2 to 8 carbon atoms, and B(III) a styrene sulfonic acid having the formula:

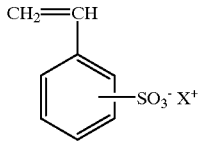

and $X^+$is a cation selected from the group consisting of hydrogen alkali metal cations, alkaline earth cations, cations of the transition metals—Sc, Ti, V, Cr, Mn, Fe, Co, Ni, Cu, Zn, and ammonium cations of the following formula:

$$R_5R_6R_7R_8N^+$$

where $R_5$, $R_6$ $R_7$, and $R_8$ are independently hydrogen or hydrocarbyl groups, provided that the total number of carbon atoms in an ammonium cation does not exceed 21 carbon atoms and further provided that if A is A(I) then the ratio of moles of A to B is in the range of 95:5 to 25:75 and if A is A(II), then the ratio of moles of A to B is in the range of 90:10 to 25:75.

DETAILED DESCRIPTION OF THE INVENTION

The term "hydrocarbyl" includes hydrocarbon, as well as substantially hydrocarbon, groups. Substantially hydrocarbon describes groups which contain non-hydrocarbon substituents which do not alter the predominantely hydrocarbon nature of the group.

Examples of hydrocarbyl groups include the following:

(1) hydrocarbon substituents, that is, aliphatic (e.g., alkyl or alkenyl), alicyclic (e.g., cycloalkyl, cycloalkenyl) substituents, aromatic-, aliphatic- and acylic-substituted aromatic substituents and the like as well as cyclic substituents wherein the ring is completed through another portion of the molecule (that is, for example, any two indicated substituents may together form an alicyclic radical);

(2) substituted hydrocarbon substituents, that is, those substituents containing non-hydrocarbon groups which, in the context of this invention, do not alter the predominantly hydrocarbon substituent; those skilled in the art will be aware of such groups (e.g., halo (especially chloro and fluoro), hydroxy, alkoxy, mercapto, alkylmercapto, nitro, nitroso, sulfoxy, etc.); and (3) hetero substituents, that is, substituents which will, while having a predominantly hydrocarbon character within the context of this invention, contain other than carbon present in a ring or chain otherwise composed of carbon atoms. Suitable heteroatoms will be apparent to those of ordinary skill in the art and include, for example, sulfur, oxygen, nitrogen and such substituents as, e.g., pyridyl, furyl, thienyl, imidazole, etc. In general, no more than about 2, preferably no more than one, non-hydrocarbon substituent will be present for every ten carbon atoms in the hydrocarbyl group. Typically, there will be no such non-hydrocarbon substituents in the hydrocarbyl group. In that case, the hydrocarbyl group is purely hydrocarbon.

COPOLYMER

The anti-misting aqueous compositions contain a copolymer which is formed by the copolymerization of a water soluble monomer, often referred to as a hydrophilic monomer, and a water insoluble monomer often referred to as a hydrophobic monomer. The hydrophobic monomers are alkyl substituted acrylamides, alkyl substituted methacrylamides, acrylate esters and methacrylate esters, the hydrophilic monomers are sulfonate molecules containing a single ethylenic linkage. When the polymer contains alkyl substituted acrylamides and alkyl substituted methacrylamides as the hydophobic monomer then the molar percentage of the hydrophobic monomer is in the range of 25 to 95 percent. In this case, the molar percentage of the hydrophilic monomer is in the ratio of 5 to 75 molar percent. When the polymer contains alkyl substituted acrylates and alkyl substituted methacrylates as the hydophobic monomer then the molar percentage of hydrophobic monomer is 25 to 90 percent and the molar percentage of the hydrophilic monomer is 10 to 75 percent. In the polymerization reaction the ethylenic linkages polymerize and the resulting polymer consists of a polyethylene backbone with hydrophilic and hydrophobic side chains. Polyvinyl cross-linking monomers are not included among the monomers which may be used in the practice of the present invention. Cross-linking monomers are not desirable in the polymers of the present invention.

VISCOSITY:

Measurements of solution viscosity were made by comparing the efflux time t required for a specified volume of polymer solution to flow through a capillary tube (Ostwald-Fenske capillary viscometer) with the corresponding efflux time $t_o$ of the solvent. From t, $t_o$ and the polymer concentration c, the inherent viscosity is derived based on the following equation $$h_{inh}=[\ln(t/t_o)]/c$$

where the concentration c is expressed in grams per deciliter (g/dl).

Methanol was used as solvent. All inherent viscosities were measured at 30° C. and c=1.0 g/dl.

HYDROPHILIC MONOMERS

The hydrophilic monomers usable in the present invention are ethylenic monomers containing a sulfonate group. Three types of sulfonate monomers have been found to be useful in the present invention. The first type of hydrophilic monomers are the substituted acrylamides containing a sulfonate group:

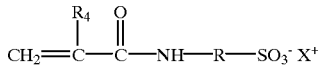

wherein $R_4$ is a hydrogen or a methyl group and R is an aliphatic or an aromatic hydrocarbon group containing from two (2) to eight (8) carbon atoms or 4 to 8 carbon atoms which acts as a bridge between the nitrogen portion of the acrylamido group, and the sulfonate group. The R group may be branched as in the molecule 2-acrylamido-2-methylpropane sulfonic acid which has the following structure:

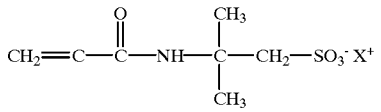

The R group may also include phenyl groups, alkyl substituted phenyl group and cycloaliphatic groups. The second type of sulfonate monomer are the substituted acrylamides containing two sulfonate group structures:

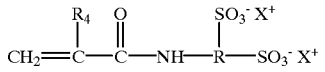

wherein $R_4$ is a hydrogen or a methyl group and R is as defined above for the acrylamides with a single sulfonate group. The sulfonate groups may be attached to the same or different carbon atoms.

The third type is the styrene sulfonate illustrated by the following formula:

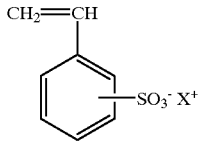

The $X^+$ is a cation selected from the group consisting of hydrogen alkali metal cations, alkaline earth cations, cations of the transition metals—Sc, Ti, V, Cr, Mn, Fe, Co, Ni, Cu, Zn, and ammonium cations of the following formula:

$$R_5R_6R_7R_8N^+$$

where $R_5$, $R_6$, $R_7$, and $R_8$ are independently hydrogen or hydrocarbyl groups, provided that the total number of carbon atoms in an ammonium cation does not exceed 21 carbon atoms

HYDROPHOBIC MONOMERS

The hydrophobic monomer may be an acrylamide or methacrylamide corresponding to the following formula:

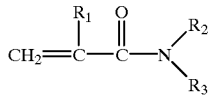

In this formula, $R_1$ may either be a hydrogen or a methyl group corresponding to an acrylamide or a methacrylamide respectively. $R_2$ and $R_3$ are independently a hydrogen or hydrocarbyl group provided that the total number of carbons in $R_2$ and $R_3$ is in the range of 2 to 36 carbon atoms. Accordingly, when $R_2$ is a methyl group then $R_3$ must be an alkyl group rather than a hydrogen. It is preferred that the total number of carbon atoms in $R_2$ and $R_3$ be in the range of 4 to 36 carbon atoms, or 4 to 24 carbon atoms, or 4 to 12 carbon atoms. Other preferred ranges for the total number of carbon atoms in $R_2$ and $R_3$ are 8 to 36 carbon atoms, or 8 to 24 carbon atoms, or 8 to 12 carbon atoms. The most preferred range for the total number of carbon atoms in $R_2$ and $R_3$ is 4 to 8 carbon atoms.

The hydrophobic monomer may also be an acrylate or methacrylate ester of the formula:

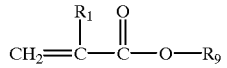

where $R_1$ is a hydrogen or a methyl group and $R_9$ is a hydrocarbyl group containing between 1 and 20 carbon atoms. It is preferred that $R_9$ contain between 2–18 carbon atoms, 4 to 18 carbon atoms, 4 to 12, 4 to 8 carbon atoms, 8 to 20 carbon atoms, 8to 18 carbon atoms, 8–16 carbon atoms, or 8–12 carbon atoms.

FORMATION OF THE COPOLYMER

The copolymer is produced by free radical polymerization. The polymerization is done by well-known free radical methods. The general properties of acrylamide polymers, as well as their methods of preparation are discussed in *The Encyclopedia of Polymer Science and Engineering*, Volume 1, John Wiley & Sons, 1985 (pp 169–211). The Encyclopedia discusses techniques useful in forming acrylic ester polymers (pp 265–273). The polymerization may be conducted in solution, and by various suspension or emulsion methods. In solution polymerization, a solvent is selected which allows both the hydrophilic and hydrophobic monomers to be maintained in solution. Mixtures of water, acetic acid, various molecular weight alcohols such as, methanol, ethanol and butyl alcohol, as well as polar solvents such as acetone, acetic acid, tetrahydrofuran, dimethyl sulfoxide, dioxane, dimethyl formamide and N-methylpyrrolidinone. A wide variety of free radical sources may be used as initiators including persulfates, redox couples, azo compounds and the like. In particular, emulsion polymerization methods may be used to form polymers useful in the present invention. The preferred method of polymerization is solution polymerization and is illustrated in the following examples.

POLYMER PREPARATION

EXAMPLE 1

A 200 ml resin flask was charged with 40 grams (0.101 moles) of 2-acrylamido-2-methylpropanesulfonic acid sodium salt (58% monomer, 42% $H_2O$), 4.3 g (0.033 moles)

of t-butylacrylamide (t-BAA), 0.014 g (0.00016 mol) of sodium bicarbonate ($NaHCO_3$) and 20 g of MeOH. A nitrogen purge at 0.1 SCFH was begun and the mixture was heated to 70° C. with stirring.

In a separate beaker 0.014 g. (0.00006 mol) of sodium persulfate ($Na_2S_2O_8$) was dissolved in 3 g of $H_2O$. This solution was taken up in a 20 ml syringe. The syringe was placed on a syringe pump which was set to deliver 0.07 ml/minute.

The $Na_2S_2O_8$ solution was added, via the syringe pump, to the resin flask over a 45 minute period. The two monomers combined made up 42.7% of the total mixture. Thirty minutes after addition was complete, 20 ml of $H_2O$ and 45 ml of MeOH were added and the mixture was stirred at 70° C. for three hours. The contents of the flask were poured into a crystallizing dish and dried at 80° C. for 20 hours to yield 27.5 g. (100%) of product containing 11.3% sulfur and 6.4% nitrogen and had an inherent viscosity of 2.28 dl/g at 30° C. in MeOH.

Additional examples were prepared using the same method and different proportions of the monomers. The results are set forth in Table I.

TABLE 1

Hydophobic monomer = t-Butyl acrylamide
Hydophilic monomer = 2-Acrylamido-2-methylpropane sulfonic acid Na salt

| Hydrophobic/Hydrophilic Monomer Molar Ratio | | | | | | Initial | Polymer Product | | Inherent |
|---|---|---|---|---|---|---|---|---|---|
| Ex. | hydro-phobic | hydro-philic | % monomer | $NaHCO_3$ (mole %) | $Na_2S_2O_8$ (mole %) | MeOH (ml) | % Sulfur | % Nitrogen | Vis* dl/g |
| 1 | 25 | 75 | 42.7 | 0.12 | 0.04 | 20 | 11.3 | 6.4 | 2.28 |
| 2 | 90 | 10 | 28.8 | 0.060 | 0.02 | 75 | 2.5 | 9.9 | 1.89 |
| 3 | 75 | 25 | 41 | 0.096 | 0.03 | 40 | 5.0 | 8.7 | 2.46 |
| 4 | 85 | 15 | 28 | 0.063 | 0.02 | 100 | 3.2 | 9.5 | 1.69 |
| 5 | 80 | 20 | 45 | 0.05 | 0.02 | 40 | 4.4 | 9.2 | 2.78 |
| 6 | 50 | 50 | 36 | 0.075 | 0.025 | 50 | 8.9 | 6.7 | 2.14 |
| 7 | 95 | 5 | 42 | 0.25 | 0.1 | 32 | 1.1 | 9.8 | 2.08 |

*Inherent Viscosity at 30° C. in Methanol

EXAMPLE 8

A 200 ml resin flask was charged with 59 g (0.15 moles) of 2-acrylamido-2-methylpropane sulfonic acid Na salt (58% monomer, 42% $H_2O$), 19.2 g (0.15 moles) of t-butylacrylate and 45 g. of MeOH. The mixture was stirred until homogeneous and then heated to 70° C. with a $N_2$ purge at 0.3 SCFM.

In a separate beaker 0.021 g (0.00009 mol) of $Na_2S_2O_8$ was dissolved in 2 g $H_2O$ and 1 g MeOH and the solution was taken up in a 20 ml syringe. The syringe was placed on a syringe pump which was set to deliver at 0.07 ml/min.

The initiator was added to the resin flask over approximately 45 minutes. After the addition was complete the solution was stirred for an additional 4 hours at 70° C. The contents of the flask were then poured into a crystallizing dish and dried at 90° C. overnight, to yield a product with 3.0% nitrogen, 6.5% sulfur and with an inherent viscosity of 2.1 dl/g at 30° C. in MeOH.

Additional examples were prepared using the same method and different proportions of the monomers. The results are set forth in Table II.

TABLE 2

Examples 8–10
Hydophobic monomer = t-Butyl acrylate
Hydophilic monomer = 2-Acrylamido-2-methylpropane sulfonic acid Na salt

| Hydrophobic/Hydrophilic monomer Molar Ratio | | | | | Initial | Polymer Product | | |
|---|---|---|---|---|---|---|---|---|
| Example | Hydro-phobic | hydro-philic | % monomer | $N_2S_2O_8$ (mole %) | MeOH (ml) | % Sulfur | % Nitrogen | Inherent Vis* dl/g |
| 8 | 50 | 50 | 26 | .06 | 100 | 6.3 | 3.7 | 1.1 |
| 9 | 50 | 50 | 43.1 | .03 | 45 | 6.5 | 3.0 | 2.1 |
| 10 | 65 | 35 | 39.7 | .03 | 50 | 4.8 | 2.9 | 1.8 |

*Inherent Viscosity at 30° C. in Methanol

TESTING

In order to evaluate the performance of the inventive polymers, a method was developed for a polymer's ability to reduce mist formation. This method involved pumping the liquid containing a dye and 0.5 weight percent of mist suppressant to be tested through the center tube of a coaxial air blast atomizer. Air, at high pressure flows from the outer tube of the atomizer. The test liquid is atomized and the resulting spray strikes a screen which is placed 38 centimeters from the end of the atomizer. The atomization process continues for a standard period of time after which the screen is dried. The spray emerging from the atomizer strikes the screen in a circular pattern. The size of the pattern depends on the distance of the screen from the atomizer, the liquid flow rate, the air pressure. These parameters were standardized and were held constant through the measurements described below. It was found that known mist suppressant polymers had a strong influence on the diameter of the pattern produced on the screen. Water, which may be atomized relatively easily into a fine mist, produced the largest diameter pattern. When a known mist suppressant, POLYOX® was added to the water, a large reduction in the pattern diameter was observed. Similarly, samples of the polymers disclosed herein were dissolved in water and found to substantially reduce the diameter of the spray patterns produced on the screen. The samples, approximately 350 grams of the test solutions containing each suppressant,were subjected to shear for two minutes in a Waring commercial blender Model 700 with a 20,000 RPM rotation speed. The samples were then retested for the effectiveness of the mist suppresant polymer.

The efficiency of mist suppression was calculated using the following equation:

$$\Delta D = \frac{D_{water} - D_{test\ sample}}{D_{water}}$$

where D is the diameter of the spray pattern.

TABLE 3

Changes in Mist Suppression Efficiency with Shear

| MATERIAL ID | % ΔD [Shear = 0 min in blender] | % ΔD [Shear = 2 min in blender] | % loss of mist supression with shear = 2 min |
|---|---|---|---|
| Water | 0.00 | 0.00 | 0.00 |
| 1 million Mw POLYOX | 20.33 | 6.50 | 68.00 |
| 2 million Mw POLYOX | 39.84 | 2.68 | 93.27 |
| (Ex 5) | 18.13 | 20.73 | (14.34) |
| (Ex 3) | 16.67 | 14.23 | 14.64 gain |
| (Ex 6) | 10.16 | 8.37 | 17.60 |
| (Ex 9) | 17.32 | 8.94 | 48.36 |
| (Ex 10) | 19.11 | 12.20 | 36.17 |

COMPOSITIONS

The metal working fluids of the present invention include aqueous based, oil-free compositions. In their simplest form, these compositions include water, and the antimisting polymer. It is desireable to include the polymer at a level which is effective to suppress mist. However, even with recovery of used metal working fluids some is lost in use and the antimisting polymer is an expense. Accordingly, it is also desirable to use the antimisting polymers at the lower levels of their effective concentration range. Many factors affect the level of polymer required to achieve an antimisting effect. The shape of the tool and the work piece, the shear level in the particular application, and the rate of movement of the workpiece all influence the amount of mist supression required. The antimisting polymer is used in a concentration range of 0.02 weight percent to 10 weight percent based upon the total weight of the composition. A mixture of the antimisting polymers may also be used to prepare the compositions.

In addition to the antimisting polymer, the aqueous metal working fluids may contain additives to improve the properties of the composition. These additives include anti-foam agents, metal deactivators, and corrosion inhibitors, antimicrobial, anticorrosion, extreme pressure, antiwear, antifriction, and antirust agents. Such materials are well known to those skilled in the art.

The metal working fluids of the present invention may also be oil-in-water emulsions. The emulsion compositions contain the same types and amounts of antimisting polymers as the purely aqueous compositions discussed above. The compositions may also contain the property improving additives which have been used in the purely aqueous fluids noted above.

The oils used in the emulsion compositions may include petroleum oils, such as oils of lubricating viscosity, crude oils, diesel oils, mineral seal oils, kerosenes, fuel oils, white oils, and aromatic oils. Liquid oils include natural lubricating oils, such as animal oils, vegetable oils, mineral lubricating oils, solvent or acid treated mineral oils, oils derived from coal or shale, and synthetic oils. Synthetic oils include hydrocarbon oils and halo-substituted hydrocarbon oils such as polymerized and interpolymerized olefins, for example polybutylenes, polypropylenes, propylene-isobutylene copolymers, chlorinated polybutylenes, poly(1-hexenes), poly(1-octenes), poly(1-decenes); alkyl benzenes, such as dodecylbenzenes, tetradecylbenzenes, dinonylbenzenes, di-(2-ethylhexyl)benzenes; polyphenyls such as biphenyls, terphenyls, and alkylated polyphenyls; and alkylated diphenyl ethers and alkylated diphenyl sulfides and derivatives, analogs and homologs thereof.

Alkylene oxide polymers and derivatives thereof where terminal hydroxy groups have been modified by esterification, etherification etc. constitute another class of synthetic oils. These are exemplified by polyoxyalkylene polymers prepared by the polymerization of ethylene oxide or propylene oxide, the alkyl and aryl ethers of these polyoxyalkylene polymers such as methyl-polyisopropylene glycol ethers, diphenyl and diethyl ethers of polyethylene glycol; and mono and polycarboxylic esters thereof, for example, the acetic esters, mixed $C_3$–$C_8$, fatty acid esters and $C_{13}$ OxO diester of tetraethylene glycol. Simple aliphatic ethers may be used as synthetic oils, such as, dioctyl ether, didecyl ether, di(2-ethylhexyl) ether.

Another suitable class of synthetic oils comprises the esters of fatty acids such as ethyl oleate, lauryl hexanoate, and decyl palmitate. The esters of dicarboxylic acids such as phthalic acid, succinic acid, maleic acid, azelaic acid, sebacic acid, fumaric acid, adipic acid, linoleic acid dimer, malonic acid, alkyl malonic acids, alkenyl malonic acids with a variety of alcohols such as butyl alcohol, hexyl alcohol, dodecyl alcohol, 2-ethylhexyl alcohol, ethylene glycol, diethylene glycol monoethyl ether, propylene glycol. Specific examples of these esters include dibutyl adipate, di(2-ethylhexyl) sebacate, di-n-hexyl fumarate, dioctyl sebacate, diisoctyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethyl-hexanoic acid.

The ratio of oil to water may vary from about 1:5 to about 1:200. Any oil-in-water emulsifier may be used to prepare the emulsions of the present invention. Emulsifiers may be single materials or may be mixtures of surfactants. Typical emulsifiers include alkali metal sulfonates and carboxylates, salts derived from the reaction product of carboxylic acylating agents with amines and hydroxylamines, polyols, polyether glycols, polyethers, and polyesters and the like. *The Kirk-Othmer Encylopedia of Chemical Technology* (3rd. Edition V. 8 pp. 900–930) provides a good discussion of emulsions and provides a list of emulsifiers useful in preparation of oil-in-water emulsions.

OTHER INGREDIENTS

A typical metal working fluid would include other components such as anti-foam agents, metal deactivators, corrosion inhibitors, antimicrobial, extreme pressure, antiwear, antifriction, and antirust agents. Typical anti-friction agents include overbased sulfonates, sulfurized olefins, chlorinated paraffins and olefins, sulfurized ester olefins, amine terminated polyglycols, and sodium dioctyl phosphate salts. Useful anti-foam agents include: alkyl polymethacrylates, and polymethylsiloxanes. Metal deactivators include materials such as tolyltriazoles. Corrosion inhibitors include carboxylic/boric acid diamine salts, carboxylic acid amine salts, alkanol amines, alkanol amine borates and the like.

What is claimed is:

1. A method for reducing mist formation in a high shear aqueous system which involves application of an aqueous composition to said high shear system, comprising: including in said aqueous composition, a copolymer formed by copolymerizing (A) a hydrophobic monomer selected from the group consisting of A(I) an alkyl substituted acrylamide compound represented by the formula:

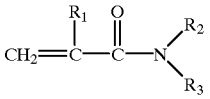

wherein $R_1$ is a hydrogen or a methyl group and $R_2$ and $R_3$ are independently hydrogen or hydrocarbyl groups, provided that the total number of carbon atoms in $R_2$ and $R_3$ combined is 2 to 36; and A(II) an acrylate ester represented by the formula:

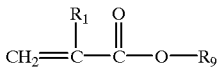

where $R_1$ is a hydrogen or a methyl group and $R_9$ is a hydrocarbyl group containing 1 to 20 carbon atoms; and (B) a hydrophilic monomer selected from the group consisting of B(I) an acrylamido sulfonic acid represented by the formula:

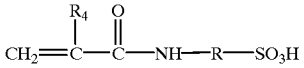

and salts thereof, wherein $R_4$ is a hydrogen or a methyl group and R is an aliphatic or aromatic hydrocarbon group containing 2 to 8 carbon atoms; and B(II) an acrylamido disulfonic acid represented by the formula:

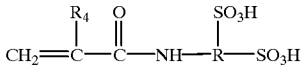

and salts thereof, wherein $R_4$ is a hydrogen or a methyl group and R is an aliphatic or aromatic hydrocarbon group containing 2 to 8 carbon atoms; and B(III) a styrenic sulfonic acid represented by the formula:

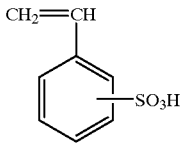

and salts thereof, wherein the salts are selected from the group consisiting of alkali metal salts, alkaline earth metal salts, salts of the metals Sc, Ti, V, Cr, Mn, Fe, Co, Ni, Cu and Zn, and ammonium salts, wherein the ammonium ion is represented by the formula $R_5R_6R_7R_8N^+$ where $R_5$, $R_6$, $R_7$, and $R_8$ are independently hydrogen or hydrocarbyl groups;

provided that the total number of carbon atoms in said ammonium ion does not exceed 21; and further provided that if A is A(I) then the ratio of moles of A to B is in the range of 95:5 to 25:75; and if A is A(II), then the ratio of moles of A to B is in the range of 90:10 to 25:75.

2. The method of claim 1 wherein the hydrophobic monomer is A(I).

3. The method of claim 2 wherein the total number of carbon atoms in $R_2$ and $R_3$ combined is 4 to 24 carbons.

4. The method of claim 3 wherein the total number of carbon atoms in $R_2$ and $R_3$ combined is 4 to 12 carbons.

5. The method of claim 2 wherein the total number of carbon atoms in $R_2$ and $R_3$ combined is 4 to 8 carbons.

6. The method of claim 2 wherein the total number of carbon atoms in $R_2$ and $R_3$ combined is 8 to 24 carbons.

7. The method of claim 2 wherein the total number of carbon atoms in $R_2$ and $R_3$ combined is 8 to 12 carbons.

8. The method of claim 1 wherein the hydrophobic monomer is A(II).

9. The method of claim 8 wherein $R_9$ contains 2 to 18 carbon atoms.

10. The method of claim 8 wherein $R_9$ contains 4 to 18 carbon atoms.

11. The method of claim 8 wherein $R_9$ contains 4 to 12 carbon atoms.

12. The method of claim 8 wherein $R_9$ contains 4 to 8 carbon atoms.

13. The method of claim 8 wherein $R_9$ contains 8 to 18 carbon atoms.

14. The method of claim 8 wherein $R_9$ contains 8 to 12 carbon atoms.

15. The method of claim 2 wherein the hydrophilic monomer is B(I).

16. The method of claim 15 wherein R contains 4 to 8 carbon atoms.

17. The method of claim 15 wherein the hydrophilic monomer is 2-acrylamido-2-methylpropane sulfonic acid sodium salt.

18. The method of claim 1 wherein the hydrophilic monomer is 2-acrylamido-2-methylpropane sulfonic acid sodium salt and the hydrophobic monomer is t-butylacrylamide.

19. The method of claim 1 wherein the aqueous composition further comprises an oil and an emulsifier, wherein the aqueous composition is an oil-in-water emulsion.

20. A method for lubricating a metal workpiece in a cutting operation, comprising: supplying to said workpiece a composition comprising (a) water and (b) a copolymer formed by copolymerizing (A) a hydrophobic monomer selected from the group consisting of A(I) an alkyl substituted acrylamide compound represented by the formula:

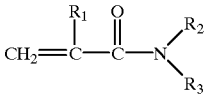

wherein $R_1$ is a hydrogen or a methyl group and $R_2$ and $R_3$ are independently hydrogen or hydrocarbyl groups, provided that the total number of carbon atoms in $R_2$ and $R_3$ combined is 2 to 36; and A(II) an acrylate ester represented by the formula:

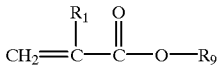

where $R_1$ is a hydrogen or a methyl group and $R_9$ is a hydrocarbyl group containing 1 to 20 carbon atoms; and (B) a hydrophilic monomer selected from the group consisting of B(I) an acrylamido sulfonic acid represented by the formula:

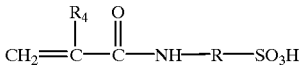

and salts thereof, wherein $R_4$ is a hydrogen or a methyl group and R is an aliphatic or aromatic hydrocarbon group containing 2 to 8 carbon atoms; and B(II) an acrylamido disulfonic acid represented by the formula:

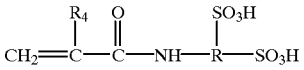

and salts thereof, wherein $R_4$ is a hydrogen or a methyl group and R is an aliphatic or aromatic hydrocarbon group containing 2 to 8 carbon atoms; and B(III) a styrenic sulfonic acid represented by the formula:

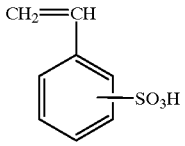

and salts thereof;

wherein the salts are selected from the group consisiting of alkali metal salts, alkaline earth metal salts, salts of the metals Sc, Ti, V, Cr, Mn, Fe, Co, Ni, Cu and Zn, and ammonium salts, wherein the ammonium ion is represented by the formula $$R_5R_6R_7R_8N^+$$

where $R_5$, R6, $R_7$, and $R_8$ are independently hydrogen or hydrocarbyl groups;

provided that the total number of carbon atoms in said ammonium ion does not exceed 21; and further provided that if A is A(I) then the ratio of moles of A to B is in the range of 95:5 to 25:75; and if A is A(II), then the ratio of moles of A to B is in the range of 90:10 to 25:75.

21. The method of claim 20 wherein the hydrophobic monomer is A(I).

22. The method of claim 21 wherein the total number of carbon atoms in $R_2$ and $R_3$ combined is 4 to 24 carbons.

23. The method of claim 20 wherein the hydrophobic monomer is A(II).

24. The method of claim 23 wherein Rg contains 2 to 18 carbon atoms.

25. The method of claim 20 wherein the hydrophilic monomer is B(I).

26. The method of claim 25 wherein R contains 4 to 8 carbon atoms.

27. The method of claim 25 wherein the hydrophilic monomer is 2-acrylamido-2-methylpropane sulfonic acid sodium salt.

28. The method of claim 20 wherein the hydrophilic monomer is 2-acrylamido-2-methylpropane sulfonic acid sodium salt and the hydrophobic monomer is t-butylacrylamide.

29. The method of claim 20 wherein the composition further comprises an oil and an emulsifier, wherein the fluid is an oil-in-water emulsion.

* * * * *

UNITED STATES PATENT AND TRADEMARK OFFICE
CERTIFICATE OF CORRECTION

PATENT NO.: 6,100,225
DATED: August 8, 2000
INVENTOR(S): Sanjay Kalhan, James T. Mann, Richard A. Denis It is certified that errors appear in the above-identified patent and that said Letters Patent is hereby corrected as shown below:

On the title page item [54], should read: SULFONATE CONTAINING COPOLYMERS AS MIST SUPPRESSANTS IN SOLUBLE OIL (WATER-BASED) METAL WORKING FLUIDS In column 14 at line 38 (the first line of claim 24) "Rg" should read --$R_9$--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*